US006050496A

United States Patent [19]

Hefler

[11] Patent Number: 6,050,496

[45] Date of Patent: Apr. 18, 2000

[54] ROTATIONAL ACTUATION FLUID CONTROL VALVE FOR A HYDRAULICALLY ACTUATED FUEL INJECTOR

[75] Inventor: Gregory W. Hefler, Chillicothe, Ill.

[73] Assignee: Caterpillar Inc., Peoria, Ill.

[21] Appl. No.: 09/213,687

[22] Filed: Dec. 17, 1998

[51] Int. Cl.[7] ..... F02M 41/16

[52] U.S. Cl. ..... 239/96; 239/88; 239/95; 239/124; 137/625.22; 137/625.65

[58] Field of Search ..... 239/124, 88, 95, 239/96; 222/319, 434; 137/625.65, 625.22

[56] References Cited

U.S. PATENT DOCUMENTS

| | | | |
|---|---|---|---|
| 2,543,010 | 2/1951 | Gardner | 137/139 |
| 3,347,262 | 10/1967 | Gibson | 137/375 |
| 4,431,161 | 2/1984 | Miller et al. | 251/133 |
| 4,632,358 | 12/1986 | Orth et al. | 251/117 |
| 4,735,233 | 4/1988 | Nogami et al. | 137/625.65 |
| 5,207,246 | 5/1993 | Meyer | 137/625.65 |
| 5,388,614 | 2/1995 | Hakamada et al. | 137/625.65 |
| 5,397,055 | 3/1995 | Paul et al. | 239/124 |
| 5,476,245 | 12/1995 | Augustin | 251/129.02 |
| 5,522,416 | 6/1996 | Farrell et al. | 137/625.65 |
| 5,687,693 | 11/1997 | Chen et al. | 123/446 |
| 5,738,075 | 4/1998 | Chen et al. | 123/446 |

*Primary Examiner*—Kevin Shaver
*Assistant Examiner*—David Deal
*Attorney, Agent, or Firm*—Eric M. Bram

[57] ABSTRACT

An actuation fluid control valve for a hydraulically actuated fuel injector comprises an injector body having an actuation fluid control passage, a low pressure actuation fluid drain passage, and a high pressure actuation fluid supply passage for accepting high pressure actuation fluid into the fuel injector. An actuator is attached to the injector body. A rotatable valve member includes a first valve passage and a second valve passage and is disposed in the injector body such that high pressure actuation fluid entering from the high pressure actuation fluid supply passage will not bias the rotatable valve member either toward the first position or toward the second position. The rotatable valve member is rotatable in response to the actuator between a first position in which the high pressure actuation fluid supply passage is in fluid communication with the actuation fluid control passage via the first valve passage, and a second position in which the high pressure actuation fluid supply passage is not in fluid communication with the actuation fluid control passage.

16 Claims, 2 Drawing Sheets

ROTATIONAL ACTUATION FLUID CONTROL VALVE FOR A HYDRAULICALLY ACTUATED FUEL INJECTOR

TECHNICAL FIELD

This invention relates generally to fuel injection, and more particularly to hydraulically actuated fuel injectors.

BACKGROUND AND SUMMARY

Known hydraulically-actuated fuel injection systems and/or components are shown, for example, in U.S. Pat. Nos. 5,687,693 and 5,738,075 issued to Chen and Hafner et al. on Nov. 18, 1997 and Apr. 14, 1998, respectfully.

In these hydraulically actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when an actuator driven actuation fluid control valve, for example a solenoid driven actuation fluid control valve, opens the injector's high pressure inlet.

Injection is ended by operating the actuator to release pressure above the intensifier piston. This in turn causes a drop in fuel pressure causing the needle check to close under the action of its return spring and end injection.

A critical component of this type of hydraulically actuated fuel injector is the actuation fluid control valve, which admits the high pressure actuating fluid to the injector. Previous solenoid driven actuation fluid control valves can suffer a pressure capability problem because the solenoid force is often not strong enough to overcome very high actuating fluid pressures. Also, because the actuation fluid pressure in the high pressure actuation fluid supply rail is not absolutely constant, there may be a stability problem caused by fluctuating actuation fluid pressure, so that the timing at which the fuel injection starts and stops can vary.

Additionally, there is some inefficiency in the previous designs, especially those using poppet valves and the like, in that there is a very short period between when the valve is admitting high pressure actuation fluid to the injector, and when the valve is allowing the actuation fluid to drain from the injector, during which the passage that allows the actuation fluid to drain may be momentarily fluidly connected to the passage through which the high pressure actuation fluid is admitted. During this time, some hydraulic fluid (or rather, hydraulic fluid pressure) is wasted.

The invention is directed to addressing one or more of the problems set forth above.

DISCLOSURE OF THE INVENTION

An actuation fluid control valve for a hydraulically actuated fuel injector comprises an injector body having an actuation fluid control passage, a low pressure actuation fluid drain passage, and a high pressure actuation fluid supply passage for accepting high pressure actuation fluid into the fuel injector. An actuator is attached with the injector body. A rotatable valve member includes a first valve passage and a second valve passage and is disposed in the injector body such that high pressure actuation fluid entering from the high pressure actuation fluid supply passage will not bias the rotatable valve member either toward the first position or toward the second position. The rotatable valve member is rotatable in response to the actuator between a first position in which the high pressure actuation fluid supply passage is in fluid communication with the actuation fluid control passage via the first valve passage, and a second position in which the high pressure actuation fluid supply passage is not in fluid communication with the actuation fluid control passage.

In another aspect of the invention, the rotatable valve member can be constructed so that there is an intermediate position between the first position and a second position, in which the actuation fluid control passage is not connected either to the low pressure actuation fluid drain passage, or to the high pressure actuation fluid supply passage.

DETAILED DESCRIPTION OF EXAMPLE EMBODIMENTS

Figure 1:
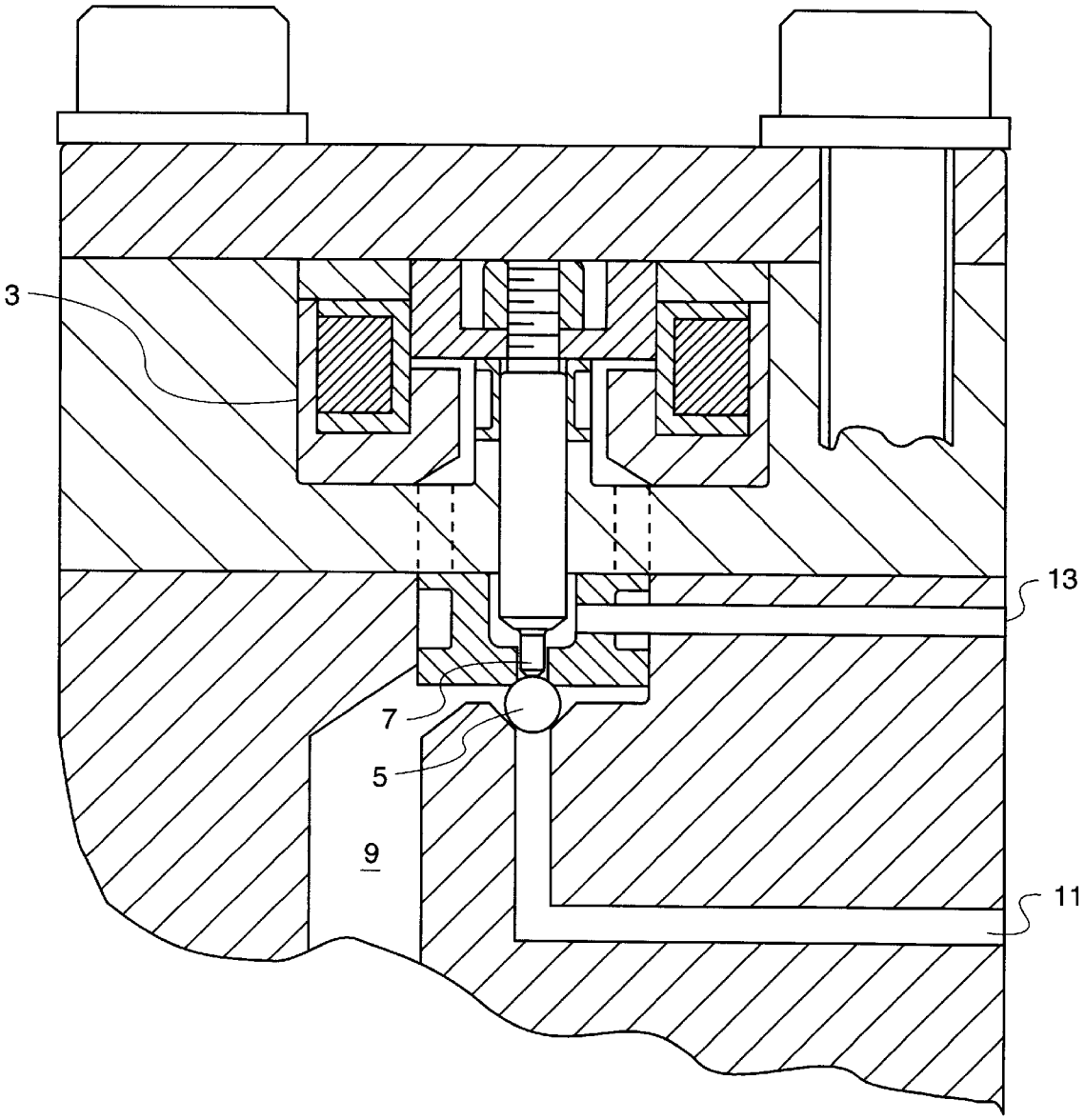
FIG. 1 illustrates a portion of a fuel injector utilizing an actuation fluid control valve including a solenoid, ball, and pin.

FIG. 1 illustrates an embodiment of a portion of a hydraulically-actuated electronically-controlled fuel injector utilizing an actuation fluid control valve including a solenoid 3, ball 5, and a pin 7. The solenoid 3 alternately opens an actuation fluid control passage 9 to a high-pressure actuation fluid supply passage 11 or to a low-pressure actuation fluid drain passage 13. It can be appreciated that with this design the high pressure actuation fluid entering from the high pressure actuation fluid supply passage 11 will bias the ball 5 toward the position in which high pressure actuation fluid is admitted from the high pressure actuation fluid supply passage 11 to the actuation fluid control passage 9. Thus, a pushing solenoid 3 must push the pin 7 and a ball 5 against the full pressure of the incoming high-pressure actuation fluid in the high-pressure actuation fluid supply passage 11. When this pressure becomes too high, it becomes difficult for the solenoid 3 to push the ball 5 quickly enough.

Additionally, because the actuation fluid pressure in the high-pressure actuation fluid supply passage 11 is not absolutely constant, the timing at which the ball 5 seals off the high pressure actuation fluid supply passage 11 can also vary. Also, there is some inefficiency in that there is a very short period during which the ball is between seats, at which time the high pressure actuation fluid supply passage 11 is momentarily fluidly connected to be low pressure actuation fluid drain passage 13. During this time, some hydraulic fluid (or rather, hydraulic fluid pressure) is wasted.

Figure 2:
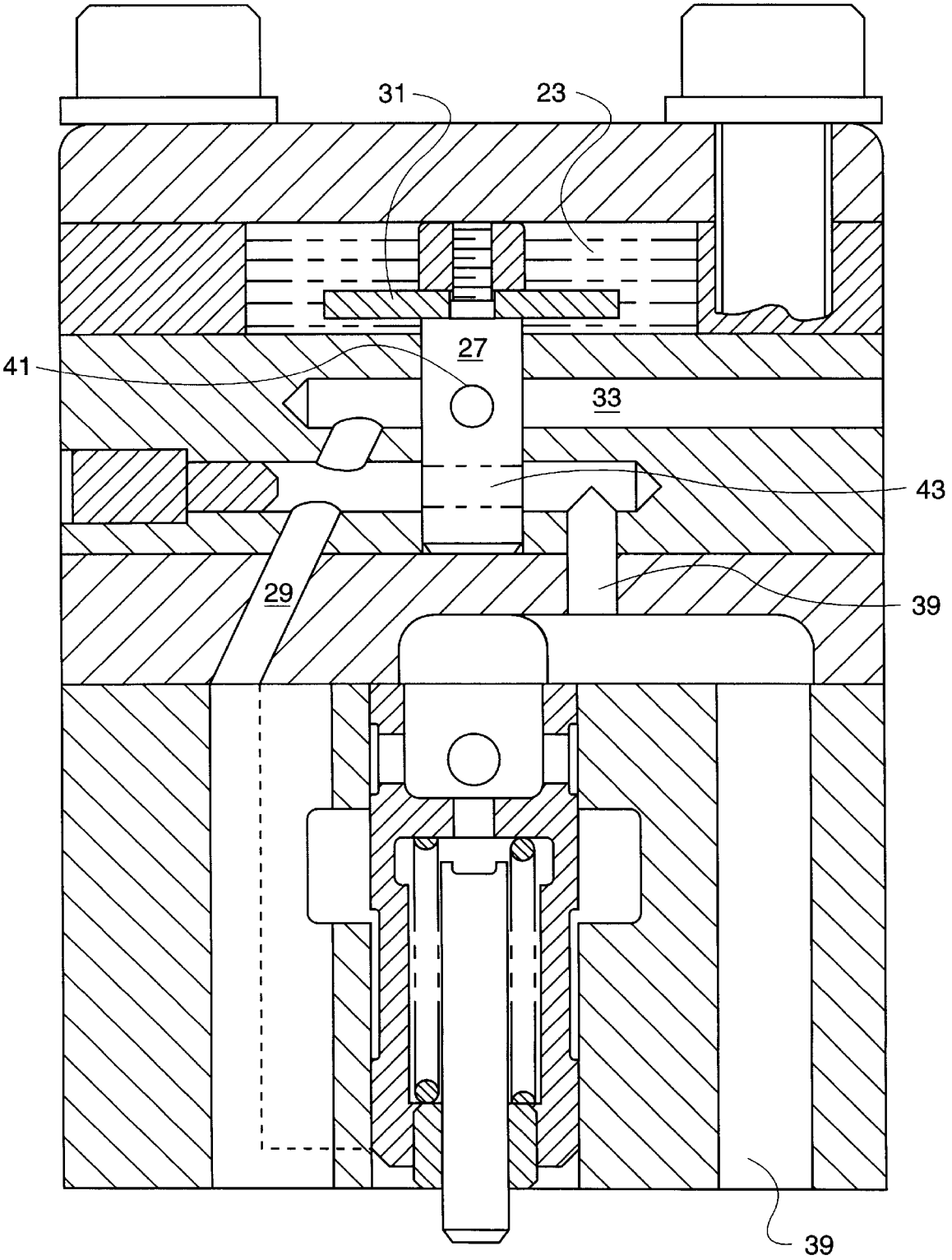
FIG. 2 illustrates an embodiment of an actuation fluid control valve within a fuel injector according to the invention, using a rotational solenoid actuator.

FIG. 2 illustrates one embodiment of an actuation fluid control valve according to the invention. This design comprises a rotatable valve 27 attached to an armature 31 of a rotational solenoid 23. The rotatable valve 27 is movable with rotation of the armature 31 between a first position where an actuation fluid control passage 29 is fluidly connected with a high pressure actuation fluid supply passage 39, and a second position where the actuation fluid control passage 29 is fluidly connected with the low pressure actuation fluid drain passage 33.

While the disclosed embodiment uses a rotating actuator, other embodiments can easily be envisioned in which instead of using a rotating actuator, a pushing or pulling actuator, for example comprising a solenoid or a piezo stack, can rotate the rotatable valve by pushing and pulling an arm or lever or such attached with the rotatable valve The rotational valve 27 includes a first valve passage 41 and a second valve passage 43. The first and second valve passages 41, 43 are positioned within the rotational valve 27 in such a way that when the rotational valve 27 is rotated to the first position, the first valve passage 41 fluidly connects the actuation fluid control passage 29 with the high pressure actuation fluid supply passage 39, but the second valve passage 43 does not fluidly connect the actuation fluid control passage 29 with the low pressure actuation fluid drain passage 33. Additionally, when the rotational valve 27 is rotated to the second position, the second valve passage 43 fluidly connects the actuation fluid control passage 29 with the low pressure actuation fluid drain passage 33, but the first valve passage 41 does not fluidly connect the actuation fluid control passage 29 with the high pressure actuation fluid supply passage 39.

INDUSTRIAL APPLICABILITY

Referring now to the fuel injector portion illustrated in FIG. 2, each injection sequence is started by energizing rotational solenoid 23 to rotate the attached rotatable valve 27 to the first position, so that the first valve passage 41 aligns with and fluidly connects the actuation fluid control passage 29 with the high pressure actuation fluid supply passage 39. The high-pressure actuation fluid can then flow into the actuation fluid control passage 29 to operate the fuel injector to allow fuel injection.

To end the injection sequence, the rotational solenoid 23 is again energized, this time to rotate the attached rotatable valve 27 to the second position, so that the first valve passage 41 moves out of alignment with the actuation fluid control passage 29 and the high pressure actuation fluid supply passage 39, thus cutting off the supply of high pressure actuation fluid that causes fuel injection. At the same time, the second valve passage 43 aligns with and fluidly connects the actuation fluid control passage 29 with the low pressure actuation fluid drain passage 33 to into fuel injection. This allows the high-pressure actuation fluid to exit the fuel injector through the low-pressure actuation fluid drain passage 33.

With this design, the actuation fluid control passage 29 is open to the high pressure actuation fluid supply passage 39 at the first position, or is open to the low pressure actuation fluid drain passage 33 at the second position. However, the high pressure actuation fluid supply passage 39 does not have to ever be open to the low pressure actuation fluid drain passage, because between the two positions (position one and position two of the valve) is a "dead zone" in which neither the first valve passage 41 nor the second valve passage 43 is aligned with either the high pressure actuation fluid supply passage 39 or the low pressure actuation fluid drain passage 33, so that neither actuation fluid supplying or draining is taking place.

The resulting design allows elimination of the ball, seats, pin, and associated alignment issues associated with these components. Additionally, impact wear from the pin's striking the ball is reduced, and the pressure capability issues are addressed as well. Also, timing becomes independent of any fluctuations in the pressure of the high-pressure actuation fluid.

Further, because the high pressure actuation fluid supply passage 39 is never fluidly connected to the low pressure actuation fluid drain passage 33, efficiency is improved because no hydraulic fluid is wasted during the switch from hydraulic fluid supplying to hydraulic fluid draining. Finally, the rotational valve design prevents the high pressure of the high-pressure actuation fluid from biasing the valve toward either position, so that position of the valve is determined more controllably by the actuator. Thus, fuel injection motion and controllability are significantly improved. Other aspects, objects, and advantages of this invention will be apparent from the drawings, the disclosure, and the appended claims.

I claim:

1. An actuation fluid control valve for a hydraulically actuated fuel injector, comprising:

an injector body having an actuation fluid control passage, a low pressure actuation fluid drain passage, and a high pressure actuation fluid supply passage for accepting high pressure actuation fluid into the fuel injector;

an actuator attached to the injector body; and a rotatable valve member including a first valve passage and a second valve passage, disposed in the injector body such that high pressure actuation fluid entering from the high pressure actuation fluid supply passage will not bias the rotatable valve member either toward the first position or toward the second position, and rotatable in response to the actuator between a first position in which the high pressure actuation fluid supply passage is in fluid communication with the actuation fluid control passage via the first valve passage, and a second position in which the high pressure actuation fluid supply passage is not in fluid communication with the actuation fluid control passage.

2. The actuation fluid control valve of claim 1, wherein the high pressure actuation fluid supply passage is in fluid communication with the low pressure actuation fluid drain passage via the second valve passage when the rotatable valve member is in the second position.

3. The actuation fluid control valve of claim 2, wherein the high-pressure actuation fluid supply passage is not in fluid communication with the actuation fluid control passage when the rotatable valve member is in the second position.

4. The actuation fluid control valve of claim 3, wherein the high-pressure actuation fluid supply passage is not in fluid communication with the low-pressure actuation fluid drain passage when the rotatable valve member is in the first position.

5. The actuation fluid control valve of claim 4, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

6. The actuation fluid control valve of claim 3, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

7. The actuation fluid control valve of claim 2, wherein the high-pressure actuation fluid supply passage is not in fluid communication with the low-pressure actuation fluid drain passage when the rotatable valve member is in the first position.

8. The actuation fluid control valve of claim 7, in which the rotatable valve member is further rotatable to an intermediate position between the first-position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

9. The actuation fluid control valve of claim 2, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

10. The actuation fluid control valve of claim 1, wherein the high-pressure actuation fluid supply passage is not in fluid communication with the actuation fluid control passage when the rotatable valve member is in the second position.

11. The actuation fluid control valve of claim 10, wherein the high-pressure actuation fluid supply passage is not in fluid communication with the low-pressure actuation fluid drain passage when the rotatable valve member is in the first position.

12. The actuation fluid control valve of claim 11, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

13. The actuation fluid control valve of claim 10, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

14. The actuation fluid control valve of claim 1, wherein the high-pressure actuation fluid supply passage is not in fluid communication with the low-pressure actuation fluid drain passage when the rotatable valve member is in the first position.

15. The actuation fluid control valve of claim 14, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

16. The actuation fluid control valve of claim 1, in which the rotatable valve member is further rotatable to an intermediate position between the first position and a second position, in which:

the actuation fluid control passage is not in fluid communication with the high pressure actuation fluid supply passage and is not in fluid communication with the low pressure actuation drain passage; and the high-pressure actuation fluid supply passage is not in fluid communication with the low-pressure actuation drain passage.

* * * * *